US010883406B2

(12) United States Patent
Trolle

(10) Patent No.: US 10,883,406 B2
(45) Date of Patent: Jan. 5, 2021

(54) CASSETTE INTEGRATED CATALYST FOR FLUE GAS CLEANING

(71) Applicant: Umicore AG & Co. KG, Hanau-Wolfgang (DE)

(72) Inventor: Henrik Trolle, Copenhagen O (DK)

(73) Assignee: Umicore AG & Co. KG, Hanau-Wolfgang (DE)

( * ) Notice: Subject to any disclaimer, the term of this patent is extended or adjusted under 35 U.S.C. 154(b) by 0 days.

(21) Appl. No.: 16/473,754

(22) PCT Filed: Dec. 19, 2017

(86) PCT No.: PCT/EP2017/083452

§ 371 (c)(1),
(2) Date: Jun. 26, 2019

(87) PCT Pub. No.: WO2018/127398

PCT Pub. Date: Jul. 12, 2018

(65) Prior Publication Data

US 2019/0331017 A1 Oct. 31, 2019

(30) Foreign Application Priority Data

Jan. 4, 2017 (DK) ..... 2017 00002

(51) Int. Cl.

| | |
|---|---|
| ***F01N 3/28*** | (2006.01) |
| ***F01N 3/10*** | (2006.01) |
| *B01D 53/94* | (2006.01) |

(52) U.S. Cl.

CPC ..... *F01N 3/2803* (2013.01); *F01N 3/10* (2013.01)

(58) Field of Classification Search

None

See application file for complete search history.

(56) References Cited

U.S. PATENT DOCUMENTS

| | | | | |
|---|---|---|---|---|
| 4,093,423 | A * | 6/1978 | Neumann | F01N 3/2853 29/213.1 |
| 2007/0033803 | A1 | 2/2007 | Lawrukovich et al. | |
| 2013/0171035 | A1* | 7/2013 | Wikaryasz | B01D 53/94 422/170 |
| 2016/0341098 | A1 | 11/2016 | Lerdung et al. | |
| 2017/0204769 | A1 | 7/2017 | Doring et al. | |

FOREIGN PATENT DOCUMENTS

| | | | |
|---|---|---|---|
| DE | 3428102 | A1 | 2/1986 |
| DE | 102014010857 | A1 | 1/2016 |
| DE | 102016109220 | A1 | 11/2016 |

OTHER PUBLICATIONS

International Search Report received in PCT/EP2017/083452 dated May 3, 2018.

Written Opinion received in PCT/EP2017/083452 dated May 3, 2018.

* cited by examiner

*Primary Examiner* — Jelitza M Perez

(74) *Attorney, Agent, or Firm* — Suzannah K. Sundby, Esq.; Canady + Lortz LLP

(57) ABSTRACT

Cassette integrated catalyst for flue gas cleaning comprises one or more depressions in the cassette wall or several of the walls to provide increased structural strength of the cassette and an improved fix of the catalyst monolith or monoliths comprised within the cassette.

20 Claims, 4 Drawing Sheets

A(1:2)

B(2:1)

C-C(2:1)

D(2:1)

CASSETTE INTEGRATED CATALYST FOR FLUE GAS CLEANING

Figure 1:
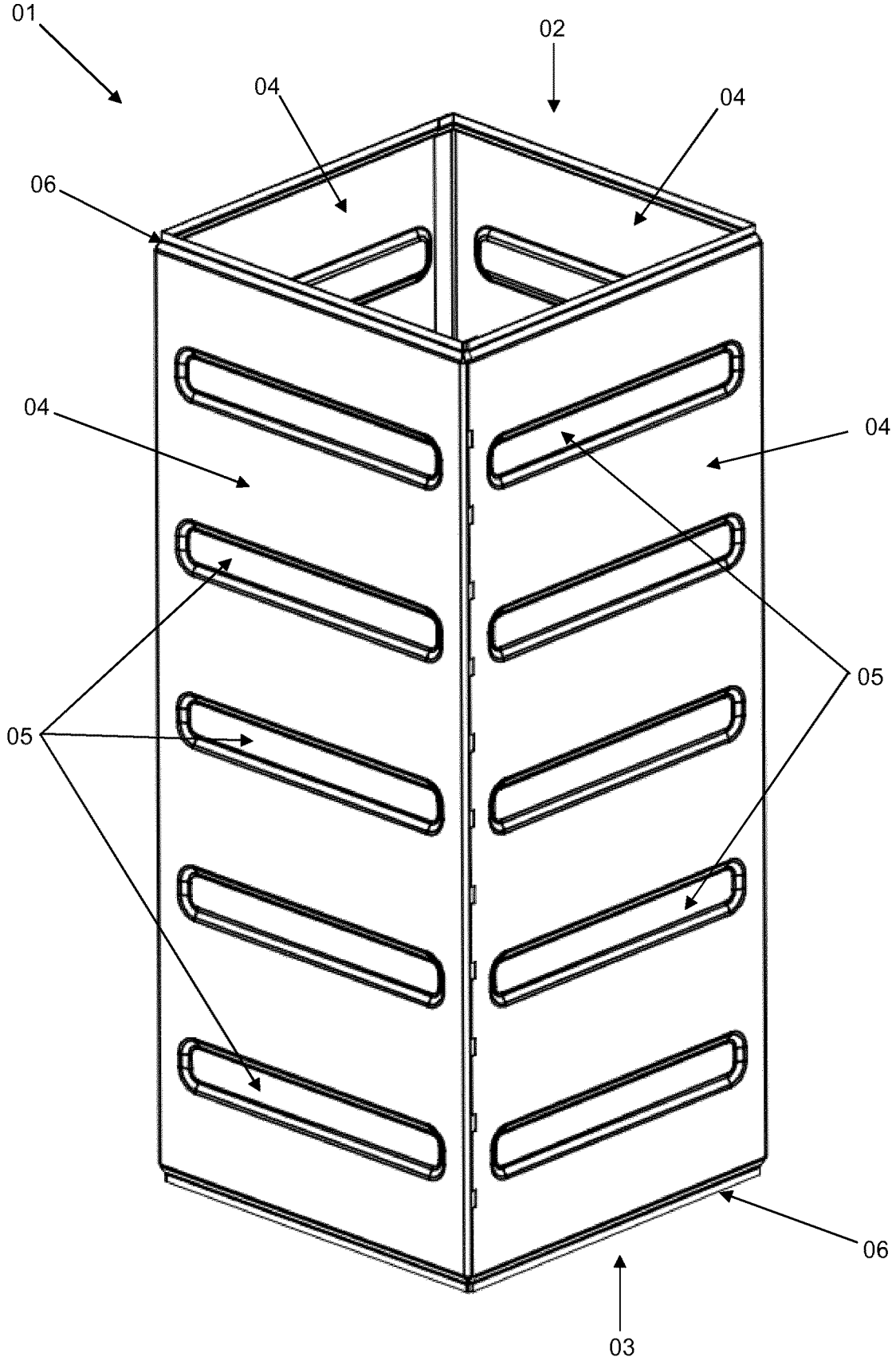

The present invention system to integrate a catalyst in a cassette to fix and protect the catalyst. In particular, the invention concerns the integration of one or more monolith catalyst in a surrounding and fixating cassette, especially for flue gas cleaning, where the cassette is modular and suited to be arranged adjacent to similar cassettes in a group.

The invention addresses the problem of installing catalysts in systems to clean a flue gas. The flue gas may be an exhaust gas from an engine, a boiler or process equipment such as cement production. The catalyst may be suited to reduction of hydrocarbons, NOx or other substances in the flue gas present. In particular, the invention is useful for the cleaning of flue gas from the exhaust of an engine, for instance, but not exclusively diesel engine exhaust.

When installing catalysts for flue gas cleaning it is necessary to fix the catalyst in the flue gas stream, e.g. in a flue gas duct or pipe. The installation must ensure that the flue gas cannot by-pass the catalyst, as the amount of flue gas by-passing the catalyst will not be cleaned by the catalyst. Furthermore, it is important that the installation of the catalyst is not excessively expensive and can be done in a safe and time-saving manner. To ensure the efficiency of the catalyst, it is important that as large a part of the cross-sectional area of the flue gas duct or pipe is covered with catalyst, especially when retrofitting an existing flue gas system or in situations where only limited space is available as for instance in maritime systems. Often the catalyst is installed in harsh environments where vibrations are present and therefore the flue gas cleaning catalyst system must be able to withstand vibrations without risking that the catalyst moves from its installed position which may lead to leaks, breakage of the catalyst or other system failures or breakage or violation of flue gas regulation rules.

Known examples of flue gas cleaning systems are for instance described in U.S. Pat. No. 5,144,797, where an exhaust gas pipe includes a plurality of segments forming at least one angular bend which preferably includes an angle of approximately 90 DEG. The segments include a first segment having a given diameter. An adaptor communicates with the first segment. A second segment communicates with the adaptor and has a diameter larger than the given diameter. A honeycomb body is disposed directly downstream of the adaptor and has a side with an end surface facing towards an exhaust gas flow. The adaptor may have a shape forcing exhaust gas to approach the end surface in a helical and/or spiral path having a curvature and pitch reducing or preventing contact between exhaust gas having already been deflected and exhaust gas newly flowing into the adaptor. The adaptor may have an inside with approximately the shape of a coiled and/or spiral tubing segment approaching the end surface and being cut open in direction toward the end surface.

US2015314236 discloses a mounting system for connecting an after-treatment component to an engine. The mounting system may include at least one flange. The mounting system may also include a support structure having a first end connected to the at least one flange, and a second end connected to an outer shell circumferentially wrapped around the after-treatment component. The mounting system may further include at least one seal disposed between the outer shell and an outer surface of the after-treatment component. The at least one seal may be configured to isolate vibration of the engine from the after-treatment In U.S. Pat. No. 4,347,219, a converter casing includes a hollow cylindrical body in which a monolithic catalyst substrate is supported by a wire-mesh cushioning element. Secured to the casing body are a pair of holding fixtures which are each fitted with an end cushioning element engageable with the adjacent end face of the catalyst substrate to hold the latter against axial displacement. The casing body includes a smaller-diameter portion, at least one larger-diameter portion and a sloped shoulder portion interposed therebetween. The holding fixtures are fixed to the larger-diameter or other end portions of the casing body in spaced relation to the cushioning element held between the catalyst substrate and the casing body. Such casing structure reduces the danger of the catalyst substrate being damaged or broken under vibration or shock to a minimum thereby to enhance the durability of the substrate and enables realization of a particularly compact and inexpensive catalytic converter.

CN204710113 describes an integrated form honeycomb formula flue gas de-nitration catalyst structure, including locating rack and catalyst skeleton, wherein the locating rack includes the stand, crossbeam and baffle, and a stand and a crossbeam working chamber of being connected and constituting rectangle space frame construction the first in proper order, the baffle is at least two, and be "ten" style of calligraphy and distribute, the catalyst skeleton presents six prismatic structures in the hope of being improved, in-lay through the location pulley and offset in the locating rack and with the baffle, the catalyst skeleton is including protection wall and drainage plate, the drainage plate inlays in the protection wall, and constitute a plurality of array arrangements of being regular hexagon water conservancy diversion hole, protection outer surface of the wall establishes the spread groove, the protection outer surface of the wall of catalyst skeleton establishes at least one ultrasonic vibration device in addition. The utility model discloses an embedded structure of assembling to having improved greatly that equipment fixing changes and use the flexibility, having reduced and use and the maintenance cost, herein can carry out effectual temperature regulation and the depositing process is prevented to the dust simultaneously in addition in the use.

WO16156163 discloses a catalytic converter unit for an exhaust gas catalytic converter, in particular an SCR catalytic converter unit for an SCR catalytic converter of a marine diesel internal combustion engine, with multiple catalytic converter modules, wherein each catalytic converter module has a ceramic catalytic converter body through which exhaust gas flows and a metallic casing for the ceramic catalytic converter body, wherein the respective ceramic catalytic converter body is received in the respective metallic casing and is surrounded in certain sections by the latter, wherein the catalytic converter modules are positioned with first flowed-through ends on a support grating, wherein a counter-brace is positioned at the opposite second flowed-through ends of the catalytic converter modules, and wherein the catalytic converter modules are clamped between the support grating and the counter-brace.

It is known in the art to wrap a catalyst for flue gas cleaning in a support. However, existing catalyst systems may experience problems enduring vibrations as they occur for instance in connection with engines or in mobile applications. The existing catalyst encasing systems which address vibration challenges tend to be heavy and expensive.

The present invention provides a solution to the problem of encasing, fixing and protecting a catalyst for flue gas cleaning which is more simple, lightweight and less expensive than existing catalyst encasing systems.

The invention provides a cassette integrated catalyst for flue gas cleaning. The catalyst is in the form of one or more monoliths which is/are encased and fixed in the cassette. The cassette has a first and a second open end which enables a fluid to flow through the monolith from the first end of the cassette, through the monolith(s) and out through the second open end of the cassette. In embodiments where the cassette comprises a plurality of monoliths, the monoliths may be arranged in serial or parallel connection relative to the fluid flow through the cassette. Consequently, when the monoliths are parallel connected in the cassette, they are arranged side by side over the inner cross sectional area of the cassette relative to the fluid flow direction from the first to the second open end of the cassette. When the monoliths are serial connected in the cassette, they are arranged one after the other in the fluid flow direction. It is also possible that the plurality of monoliths are arranged both serial and parallel within the cassette, i.e. both side by side across the cross sectional area of the cassette and one after the other in the fluid flow direction in the cassette. The cassette integrated catalyst can be used as modules, having a plurality of cassettes comprising catalyst installed in for instance a flue gas system, such as a duct or a pipe. Again the plurality of cassette integrated catalyst modules may be installed parallel, serial or both parallel and serial in a flue gas system. The cassette comprises at least one wall which is adapted to fit around the one or more monolith(s). The number of walls depends on the shape of the cassette. A cassette with a circular or ellipsoid cross sectional shape comprises a single monolith surrounding wall, whereas a cassette with a rectangular cross sectional shape comprises four walls and a cassette with a triangular cross sectional shape comprises three walls.

An essential feature of the present invention is that the one or more walls of the cassette comprise at least one depression. This depression increases the ability to fix the one or more monolith(s) in the cassette and further it increases the stiffness of the cassette wall. As the structural strength of the cassette wall is increased accordingly, the thickness of the wall, the weight, material consumption and cost of the cassette can be minimized. The one or more depressions may be oriented to project both inwards in the cassette walls towards the monolith or outwards of the cassette walls away from the monolith, as well as both inwards and outwards. In either case, the depressions increase fix of the monolith(s) in the cassette and the cassette wall structural strength and may therefore lower the wall thickness, the weight and cost of the cassette.

In the case where the depressions projects inwards in the cassette wall, the depressions provide well defined fixing points for fixing the monolith in the cassette. The monolith may be fixed by means of friction force between the monolith and the cassette, especially at the inner surface of the depressions. The fixing of the monolith in the cassette may be further increased by means of layers provided between the cassette and the monolith, such as flexible mats or glue. Each of the one or more walls of the cassette may have one or several depressions, depending on the 15 structural strength and fix of the monolith(s) needed. The depressions may further be oriented in any direction and have any advantageous shape, such as for instance oblong depressions oriented perpendicular or parallel to the flow direction of the fluid in the cassette.

In one embodiment of the invention, the cassette is arranged around the monolith(s) in a press fit. The press fit provides a tight fix of the monolith in the cassette. In some embodiments, the press fit in combination with the depressions entails slight local deformations of the monolith(s) in the area facing the depressions. The deformation of the monolith(s) may be outwards or inwards in the monolith(s) depending on the orientation of the depressions. The depressions increase the fix of the monolith(s) in the cassette, since the fix is then not only caused by friction force but also a mechanical, dent/indent lock of the monolith(s) in the cassette. It is however to be understood that the deformation of the monolith(s) which may happen in some embodiment is not a precondition for the present invention.

In a further embodiment of the invention, the cassette is made from two pieces of bent plate, formed to fit around the monolith(s) together. The bent plate pieces may be formed in 90° L-shapes to form a rectangle cross sectional shape when fit together or formed in other shapes to form a triangle, a hexagonal shape or other cross sectional shapes. The different shapes may serve the purpose of utilizing the cross sectional area of a given flue gas duct most efficiently when a number of cassette integrated catalysts according to the invention are stacked side by side within the duct. The bent plates may be fixed together around the monolith(s) by means of welding, geometrical interlocks or any other method as known in the art.

In a further embodiment of the invention, the cassette comprises one or more inward projecting edges or one or more collar adjacent to one or both open ends of the cassette. These edges may serve the purpose of providing additional structural strength to the cassette open ends, providing an additional fix of the monolith(s) within the cassette and possibly also avoiding sharp edges of the cassette.

The cassette may be made of steel plate with a thickness of 0.2 mm to 4 mm depending on the size of the cassette and the demand to structural strength in the given application. In some embodiments, the thickness of the cassette plate may only be up to 1 mm thick as the depression(s) in the cassette wall(s) increases the structural strength. Depending on the application, demand for strength, physical characteristics of the monolith(s) to mention some, the projection height of the depression(s) relative to the inner surface of the cassette wall may vary. The height may in some embodiments be from 0.5 mm to 15.0 mm or from 1.5 to 4.0 mm.

In an embodiment of the catalyst of the invention is a $NH_3$ slip catalyst, and in a further embodiment a ship engine exhaust system comprises at least one cassette integrated catalyst according to the invention as described and claimed.

FEATURES OF THE INVENTION

1. Cassette integrated catalyst for flue gas cleaning, the catalyst comprises at least one monolith and said cassette comprises
   - a first open end,
   - a second open end, and
   - at least one wall adapted to fit around said at least one monolith, wherein the cassette further comprises at least one depression in one or more of said walls to fix said at least one monolith in the cassette.

2. Cassette integrated catalyst according to feature 1, wherein said at least one depression projects inwards in the cassette.

3. Cassette integrated catalyst according to feature 1 or 2, wherein the at least one depression and the cross sectional area of the cassette is dimensioned relative to the cross sectional area of said at least one monolith to press-fit the at least one monolith in the cassette, thereby fixing the at least one monolith in the cassette.

4. Cassette integrated catalyst according to any of the preceding features, wherein the at least one wall comprises two pieces of bent plate which are compressed around said at least one monolith and fixed in the compressed position.

5. Cassette integrated catalyst according to feature 4, wherein each of said two pieces of plate comprises two 90° bends.

6. Cassette integrated catalyst according to any of the features 1-3, wherein the at least one wall comprises one piece of bent plate which is compressed around said at least one monolith and fixed in the compressed position.

7. Cassette integrated catalyst according to any of the features 4-6, wherein the bent plate or plates are fixed in the compressed position by means of welding or geometrical interlock of at least two edges of said plate or plates.

8. Cassette integrated catalyst according to any of the preceding features, wherein said cassette has a rectangular cross section.

9. Cassette integrated catalyst according to any of the preceding features, wherein said cassette has a triangular cross section.

10. Cassette integrated catalyst according to any of the preceding features, wherein said cassette has a hexagonal cross section.

11. Cassette integrated catalyst according to any of the preceding features, wherein said cassette has a circular cross section.

12. Cassette integrated catalyst according to any of the preceding features, wherein said cassette comprises a plurality of depressions on at least one of said walls.

13. Cassette integrated catalyst according to any of the preceding features, wherein said at least one depression is longitudinal, thereby providing additional stiffness to the wall comprising said at least one depression.

14. Cassette integrated catalyst according to any of the preceding features, wherein said cassette further comprises at least one collar or one or more inward projecting edges adjacent to at least one of the ends of said cassette, thereby preventing axial movement of said at least one monolith in said cassette.

15. Cassette integrated catalyst according to any of the preceding features, wherein said cassette is made from steel plate with a thickness of 0.2 mm-4 mm, preferably 0.5 mm-2 mm.

16. Cassette integrated catalyst according to any of the preceding features, wherein said at least one depression has a projection height relative to the inner surface of the wall comprising said at least one depression of 0.5 mm-15.0 mm, preferably 1.5 mm-4.0 mm.

17. Cassette integrated catalyst according to any of the preceding features, wherein the catalyst comprises a plurality of monoliths arranged one after the other is serial connection between the first end and the second end of the cassette.

18. Cassette integrated catalyst according to any of the preceding features, wherein the catalyst comprises a plurality of monoliths arranged side by side across the internal cross sectional area of the cassette.

19. Cassette integrated catalyst according to any of the preceding features, further comprising a friction enhancing cassette monolith interface.

20. Cassette integrated catalyst according to feature 19, wherein the friction enhancing cassette monolith interface comprises glue.

21. Cassette integrated catalyst according to feature 19, wherein the friction enhancing cassette monolith interface comprises a vibration damping mat material.

22. Cassette integrated catalyst according to any of the preceding features, wherein the catalyst is a $NH_3$ slip catalyst.

23. Ship engine exhaust system comprising at least one cassette integrated catalyst according to any of the features 1-22.

A more detailed description of the invention will be apparent from the following description of a specific embodiment with reference to the drawings in which—

Figure 2:
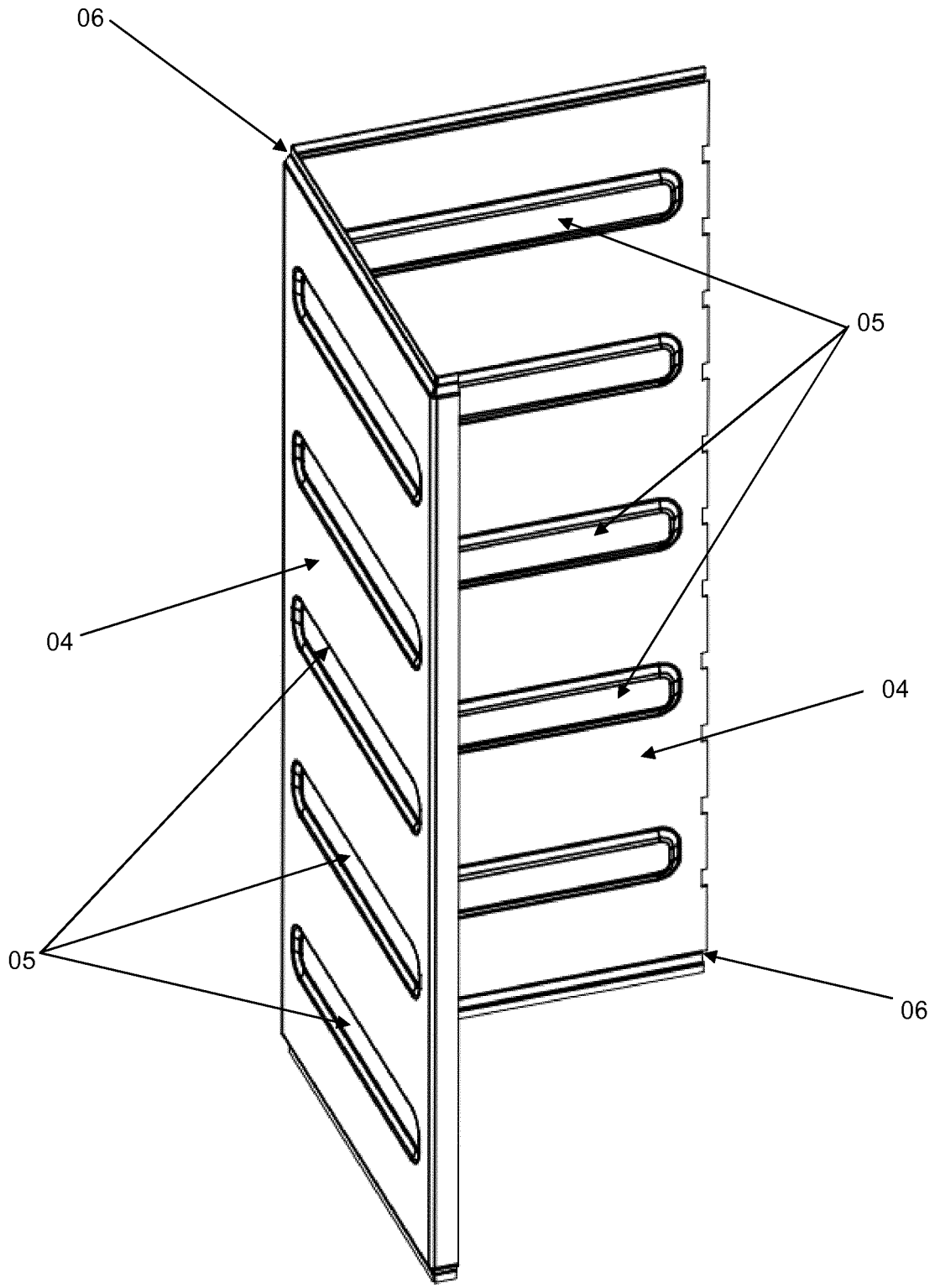
Figure 3:
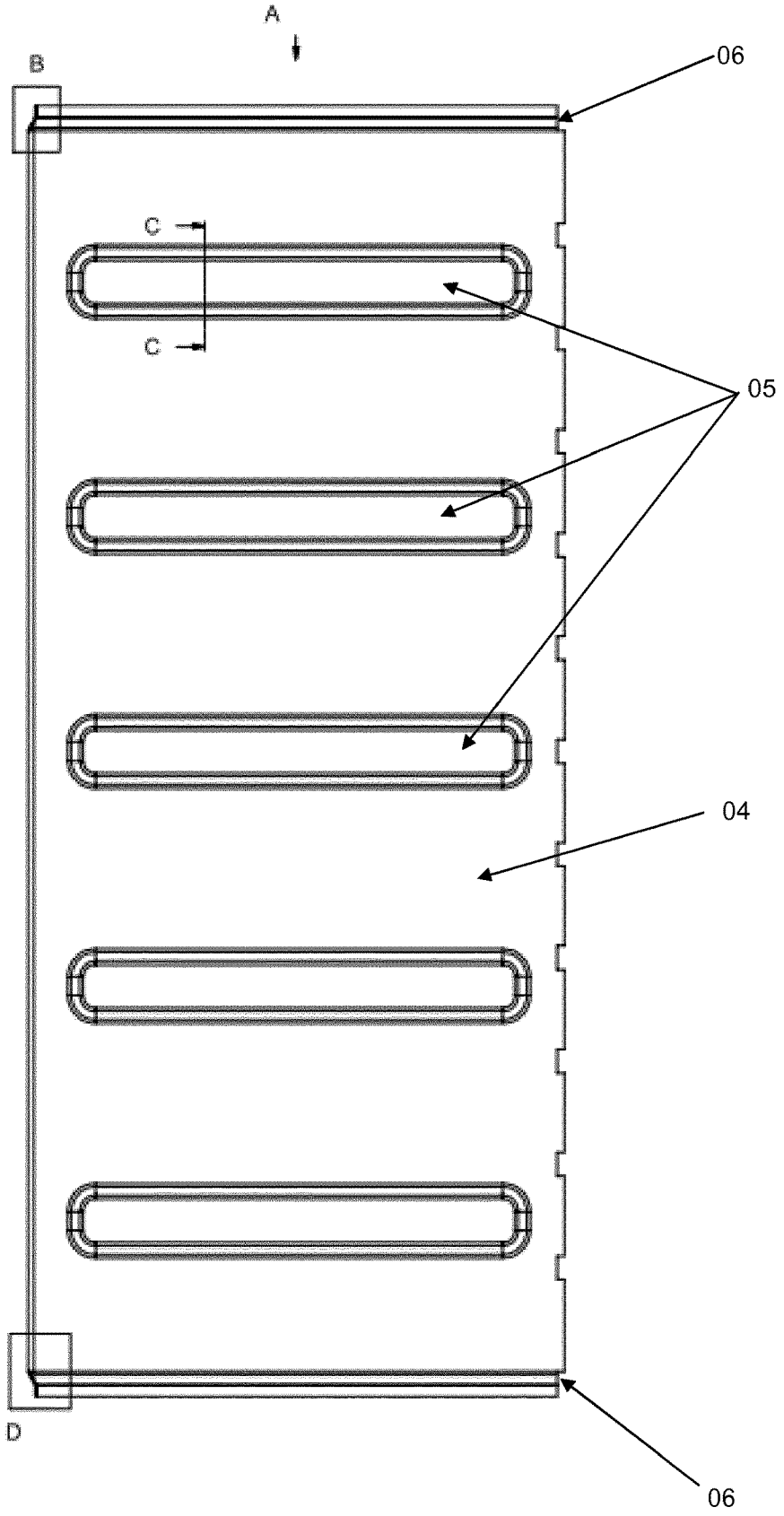
Figure 4:
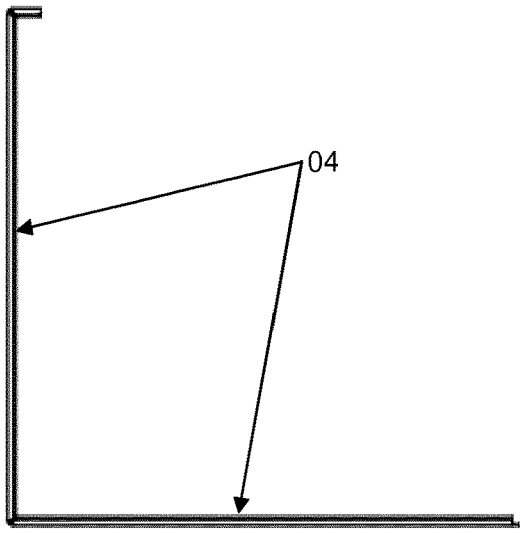
Figure 5:
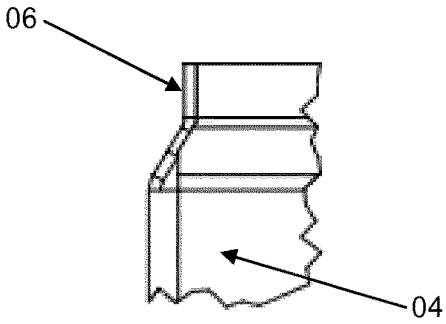
Figure 6:
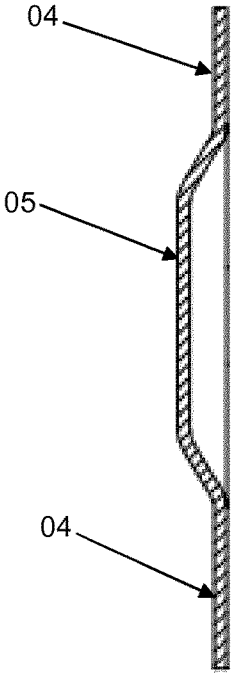
Figure 7:
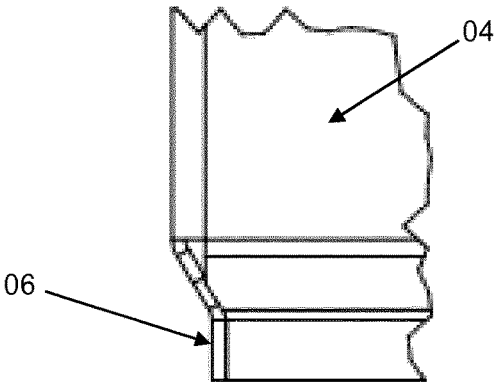

FIG. 1 shows an isometric view of the cassette with depressions but without the monolith(s), FIG. 2 shows an isometric view of a part of the cassette, FIG. 3 shows a side view of the cassette, FIG. 4 shows an end view of a part of the cassette, FIG. 5 shows a detail view of a part of the cassette shown in FIG. 3, FIG. 6 shows a cut view of a detail of the cassette shown in FIG. 3, and FIG. 7 shows a detail view of a part of the cassette shown in FIG. 3.

POSITION NUMBERS

01. Cassette.
02. First open end of cassette.
03. Second open end of cassette.
04. Cassette wall.
05. Cassette depression.
06. Cassette collar.

Referring to FIG. 1, a cassette 01 according to an embodiment of the invention is shown without the monolith(s) inside it. The cassette of this embodiment has a four cassette walls 04 adapted to enclose the sides of the monolith(s) to be mounted inside it and to fix the monolith(s) against movement relative to the cassette. When the monolith(s) are mounted within the cassette, it is adapted to receive a flue gas to be cleaned in the monolith(s) from the first open end of the cassette 02, through the monolith(s) within the cassette and further out through the second open end of the cassette 03.

On each of all four cassette walls are five cassette depressions 05, which can be seen in cut view and in more detail in FIG. 6. In this embodiment, the depressions are arranged perpendicular to the flue gas flow direction from the first to the second open end of the cassette. This provides increased structural strength to the thin-plate cassette walls, which have less tendency to bending and vibrations accordingly. Furthermore, the depressions which in this embodiment are projecting inwards in the cassette towards the monolith(s), provide a well-defined and optimized fix of the monolith(s) which are to be arranged within the cassette. As discussed in the foregoing, in an embodiment where the cassette is enclosing the monolith(s) in a press fit, the depressions may induce a slight deformation of the monolith(s) where the face of the monolith(s) are in contact with the depressions, which causes a strong fix of the monolith(s) in the cassette due to a high friction force and possibly also a mechanical dent/indent lock of the monolith(s).

The cassette showed on FIG. 1 also comprises a cassette collar 06 in both its open ends. In this embodiment the collar is two bends of the cassette wall in a slightly inwards facing S-shape as seen in more detail in FIGS. 5 and 7. This provides additional strength of the cassette wall at the open ends and also provides an end stop for the monolith(s) further securing the monolith(s) against movement in or exiting the cassette.

FIG. 2 shows an isometric view of a half part of the same cassette as shown in FIG. 1, to illustrate the mounting of the cassette around the monolith(s). As seen, the half part is a plate with two 90° bends, enabling the half part to be placed around the monolith(s), which then receives the other half part of the cassette. The two half parts are then pressed together to fit around the monolith(s) and welded along the half part wall edges. In FIG. 3, the half part is shown in side-view, revealing the edges of the half part wall which is suited for welding. The same half part is shown in an end-view in FIG. 4, revealing the two 90° bends and the wall edges.

The invention claimed is:

1. A cassette integrated catalyst for flue gas cleaning, the catalyst comprises at least one monolith and said cassette comprises:

a first open end, a second open end, and at least one wall adapted to fit around said at least one monolith, wherein the cassette further comprises at least one depression in the at least one wall to fix said at least one monolith in the cassette, the at least one wall has a bent side edge and a plurality of notches in the side opposite thereto, whereby the bent side edge and the side opposite thereto are capable of being welded together to form a corner via a lap joint and spot welds in the plurality of notches.

2. The cassette integrated catalyst according to claim 1, wherein said at least one depression projects inwards in the cassette.

3. The cassette integrated catalyst according to claim 1, wherein the at least one depression and the cross sectional area of the cassette is dimensioned relative to the cross sectional area of said at least one monolith to press-fit the at least one monolith in the cassette, thereby fixing the at least one monolith in the cassette.

4. The cassette integrated catalyst according to claim 1, wherein the at least one wall comprises a bent plate or plates which are compressed around said at least one monolith and fixed in a compressed position.

5. The cassette integrated catalyst according to claim 4, wherein the bent plate or plates comprise 90° bends.

6. The cassette integrated catalyst according to claim 1, wherein the at least one wall comprises one bent plate which is compressed around said at least one monolith and fixed in a compressed position.

7. The cassette integrated catalyst according to claim 4, wherein the bent plate or plates are fixed in the compressed position by means of welding or geometrical interlock of at least two edges of said plate or plates.

8. The cassette integrated catalyst according to claim 1, wherein said cassette has a rectangular, triangular, hexagonal, or circular cross section.

9. The cassette integrated catalyst according to claim 1, wherein said cassette comprises a plurality of depressions on at least one of said walls.

10. The cassette integrated catalyst according to claim 1, wherein said at least one depression is longitudinal, thereby providing additional stiffness to the at least one wall comprising said at least one depression.

11. The cassette integrated catalyst according to claim 1, wherein said cassette further comprises at least one collar or one or more inward projecting edges adjacent to at least one of the open ends of said cassette, thereby preventing axial movement of said at least one monolith in said cassette.

12. The cassette integrated catalyst according to claim 1, wherein said cassette is made from steel plate with a thickness of 0.2 mm-4 mm.

13. The cassette integrated catalyst according to claim 1, wherein said at least one depression has a projection height relative to an inner surface of the at least one wall comprising said at least one depression of 0.5 mm-15.0 mm.

14. The cassette integrated catalyst according to claim 1, wherein the catalyst comprises a plurality of monoliths arranged one after the other is serial connection between the first open end and the second open end of the cassette.

15. The cassette integrated catalyst according to claim 1, wherein the catalyst comprises a plurality of monoliths arranged side by side across an internal cross sectional area of the cassette.

16. The cassette integrated catalyst according to claim 1, further comprising a friction enhancing cassette monolith interface.

17. The cassette integrated catalyst according to claim 16, wherein the friction enhancing cassette monolith interface comprises glue.

18. The cassette integrated catalyst according to claim 16, wherein the friction enhancing cassette monolith interface comprises a vibration damping mat material.

19. The cassette integrated catalyst according to claim 1, wherein the catalyst is a $NH_3$ slip catalyst.

20. A ship engine exhaust system comprising at least one cassette integrated catalyst according to claim 1.

* * * * *